United States Patent [19]

Horvath et al.

[11] Patent Number: 4,689,453

[45] Date of Patent: Aug. 25, 1987

[54] GAS-BLAST SWITCH

[75] Inventors: Imre Horvath, Neerach; Lutz Niemeyer, Birr; Wolfgang Widl, Glattbrugg, all of Switzerland

[73] Assignee: BBC Brown, Boveri & Co., Ltd., Switzerland

[21] Appl. No.: 832,468

[22] Filed: Feb. 20, 1986

[30] Foreign Application Priority Data

Feb. 27, 1985 [CH] Switzerland ..... 889/85

[51] Int. Cl.[4] ..... H01H 33/82

[52] U.S. Cl. ..... 200/148 B; 200/148 R

[58] Field of Search ..... 200/148 B, 148 R, 148 A

[56] References Cited

U.S. PATENT DOCUMENTS 4,239,949 12/1980 Kii et al. ..... 200/148 B

*Primary Examiner*—Robert S. Macon

*Attorney, Agent, or Firm*—Ostrolenk, Faber, Gerb & Soffen

[57] ABSTRACT

A switch, preferably for switching medium voltages, includes a structure which creates a gas-blast to quench an arc drawn between two separating contact pieces of the switch. The gas-blast is created solely by the quenching gas which is heated by the arc, without auxiliary pressure creating mechanisms. The gas blast is sufficiently powerful to cut off high and low currents without use of pressure-controlling valves. The result is realized via a flow-off pipe located between a space where the arc develops and a gas exhaust space. One end of the flow-off pipe opens into the exhaust space. The size of the flow-off pipe is determined in part by the speed of propagation of a pressure wave which is formed in the arc space during the heating phase of the arc and the length thereof is deliberately selected such that the pressure gradient between the heated quenching gas and the arc space is maximized.

15 Claims, 5 Drawing Figures

GAS-BLAST SWITCH

BACKGROUND OF THE INVENTION

The present invention relates to a gas-blast switch.

The invention relates to gas-blast switches, of the type described in DE-C2-2,811,947. The known gas-blast switch has a heating volume which is filled with quenching gas. When the switch is opened, the quenching-gas pressure is rises in proportion to depend the intensity of the current to be cut off, as result of the heat produced by an arc drawn between two separating switch contact pieces. To obtain a quenching-gas pressure which is high enough to blow the arc when comparatively low currents are cut off, it is necessary to prevent the quenching gas from flowing off from the heating volume prematurely. This is done by means of a valve dependent on the position of the moveable contact of the two contact pieces of the switch. Moreover, a further valve is necessary to prevent overloading of the heating volume when comparatively high currents are switched.

SUMMARY OF THE INVENTION

It is an object of the invention to provide a gas-blast switch of the type mentioned above which enables high and low currents to be switched, even without the use of pressure-controlling valves.

The gas-blast switch according to the invention is characterised in that, because at least one flow-off pipe arranged between the arc space and the exhaust space is used, it becomes possible to obtain an increased pressure build-up in the heating volume even when low currents are switched. Also, an excessive pressure build up is avoided when high currents are switched. Consequently, there is no need for pressure-controlling valves, and the bursting strength of a housing receiving the heating volume can be kept comparatively low.

BRIEF DESCRIPTION OF THE DRAWINGS

The invention is explained in greater detail below with reference to several exemplary embodiments illustrated in the drawings, in which.

DETAILED DESCRIPTION OF THE DRAWINGS

Figure 1:
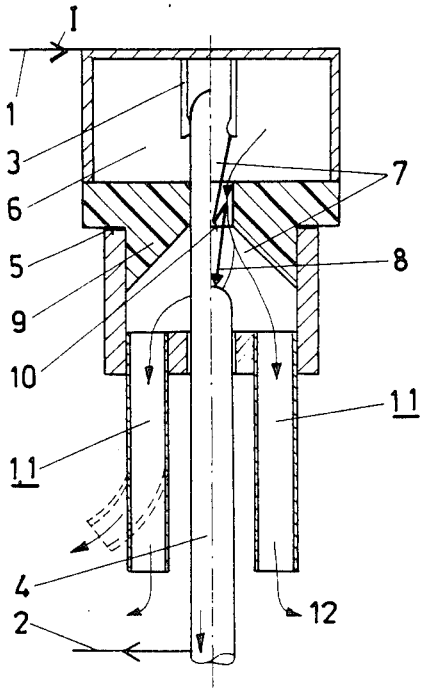
FIG. 1 is a plan view of a section through a first embodiment of a gas-blast switch of the invention.

Identical reference symbols are used throughout the figures to denote like elements. In all gas-blast switches illustrated in FIGS. 1, 3, 4 and 5, two current supply terminals 1 and 2, connected in an electrically conductive way to a fixed contact piece 3 and a moveable contact piece 4 respectively, are guided in a housing (not shown) filled with an insulation gas, such as, for example, sulphur hexafluoride, at a pressure of 4 to 6 bars. As shown on the left-hand side of FIG. 1, in a switched-on state, contact pieces 3 and 4 are in contact with one another in a switch chamber 5 located in the housing. The switch chamber 5 defines a heating volumes 6 which surrounds fixed contact piece 3, and an arc space 7 which is located between contact pieces 3 and 4 when the circuit is broken and contact 4 has moved out of heating volume 6. An arc 8 drawn between the contact pieces 3 and 4 (right-hand side of FIG. 1) burns in heating volume 6. A nozzle orifice 10 is located at the bottom of arc space 7. The nozzle is limited by an insulating body 9 and is closed by the moveable contact piece 4 in the switched-on state. The quenching gas flows therethrough in the direction of the arrow when a current I supplied approaches a zero passage. The part of the arc space 7 located downstream of the nozzle orifice 10 is connected via a flow-off pipe 11 to an exhaust space 12 enclosed by the housing (not shown). As illustrated in FIG. 1, several flow-off pipes 11 can be provided.

The switch according to the invention operates as follows: when the switch is switched off, contact piece 4 which is in contact with fixed contact piece 3 moves downwards by means of a drive (not shown). During the switching-off movement, the two contact piece separate and an arc 8 burning in the arc space 7 is drawn between the two contact pieces. As a result of its thermal effect, the arc 8 increases the pressure of the quenching gas located in the heating volume 6.

When high currents are switched, this pressure is so high that, after contact piece 4 has cleared nozzle orifice 10, a quenching-gas flow conveyed out of the heating volume 6, through arc space 7 and flow-off pipe 11 to the exhaust space 12 causes intensive blowing of arc 8. At the same time, since the heating volume 6 communicates virtually constantly with exhaust space 12 and the cool gas located in the flow-off pipe 11 is blown out at the speed of sound as a result of the prevailing supercritical pressure conditions, the heating volume 6 is prevented from being subjected to excessive pressure.

When low currents are switched, after contact 4 has cleared nozzle orifice 10 the cool quenching gas located in flow-off pipe 11 blocks for a longer period the flow-off of heated quenching gas from the arc space 7 and from heating volume 6. Because of the lower pressure the quenching gas is blown out at a substantially lower speed than the speed of sound. At the approach to a zero crossing, even in this case of low current the cool quenching gas is forced out of the flow-off pipe 11 by the quenching gas which is under increased pressure and which is located in the heating volume 6. Consequently, the arc 8 is blown out. In comparison with a gas-blast switch without a flow-off pipe of this type, during the heating-phase there is in the heating volume 6 a quenching-gas pressure which is higher than the filling pressure $P_F$ of the quenching gas located in the switch chamber 5 and which at the zero crossing is higher than the filling pressure $P_F$ of the quenching gas by the amount $\Delta P_1$. This additional pressure increase is generally adequate to make it possible to blow the arc 8 sufficiently at the zero crossing.

The situation described above is illustrated in FIG. 2 which indicates the curves of the current I to be switched and of the quenching-gas pressure $P_1$ immediately downstream of nozzle orifice 10 and the pressure $P_{1H}$ in heating volume 6, during a period T of the current to be cut off, starting after the moment in time $t_0$, on a gas-blast switching according to the invention with an approximately 0.7 m long flow-off pipe. During the high-current phase following time instant $t_0$, flow-off pipe 11 makes it possible to increase the pressure $P_1$ of the quenching gas downstream of the nozzle orifice 10 to a maximum value. The gas pressure in the heating volume 6 also increases correspondingly to this value. At the approach to the zero crossing at time instant $t_0+t/2$, the pressure $P_1$ of the quenching gas immediately downstream of the nozzle orifice 10 has fallen to the value of the filling pressure $P_F$ of the quenching gas, and there is available for blowing the arc 8 a pressure difference of $\Delta P_1$, which results from the difference between the quenching-gas pressures in the heating volume 6 and immediately behind the nozzle orifice 10.

An additional increase in the pressure difference available for blowing the arc 8 at the zero crossing is obtained if the distance L between the nozzle orifice 10 and the end of the flow-off pipe 11 which opens towards the exhaust space 12 is optimized as follows. It has been shown that with a distance L of between c/32f and c/5f, c being the speed of sound in the quenching gas under filling conditions and f being the main's frequency of the current to be cut off, an additional increase in the effective pressure difference $\Delta P_1$ across the nozzle orifice 10 is obtained. Here, the upper and lower limits of the distance L are determined by a compression wave which develops in the heating phase of the arc and which is propagated in the quenching gas at the speed of sound, and which is conducted in the flow-off pipe 11 and reflected at the open end of the latter as a dilution wave.

Depending on whether one or two reflections are desired, size ranges for the distance L of c/16f to c/5f and c/10f to c/32f are obtained.

In gas-blast switches for comparatively high short-circuit currents, it is particularly advantageous to make the distance L greater than c/10f and less than c/5f, since the transit time of the dilution wave in the flow-off pipe 11 is then calculated so that this wave, after being reflected at the open end of the flow-off pipe 11, appears in the region of nozzle orifice 10 approximately at the moment of the zero passage and causes a considerable pressure drop there.

Figure 2:
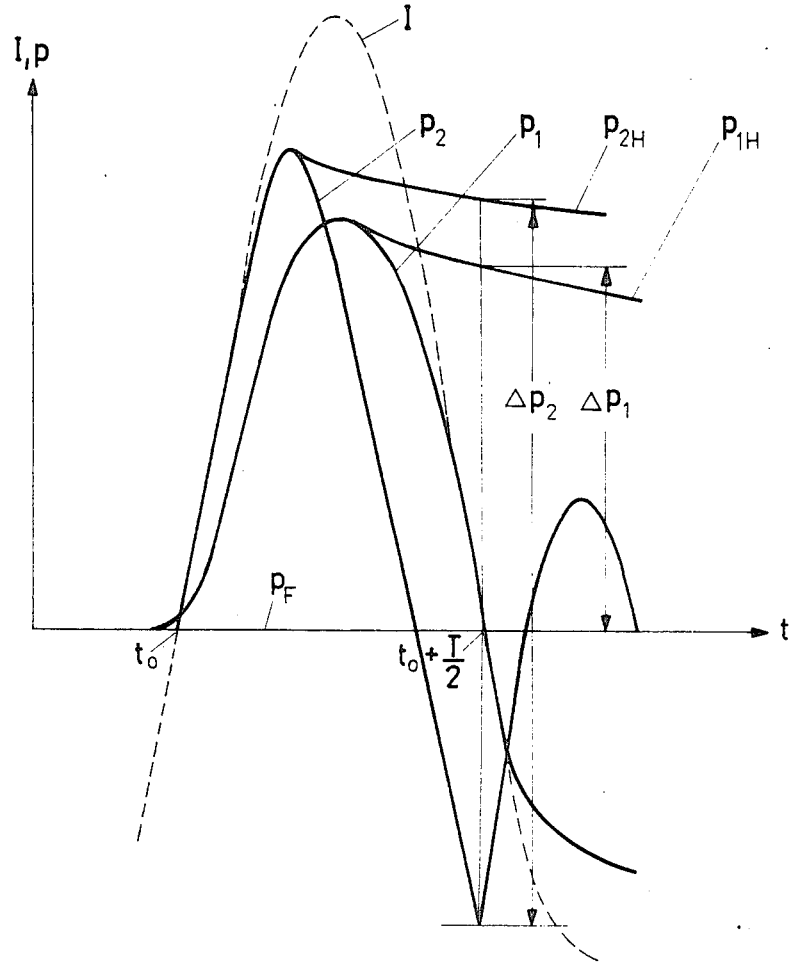
FIG. 2 shows a diagram indicating the time dependence of the current I and the quenching-gas pressure $P_1$ and $P_2$ immediately downstream of a nozzle orifice, on a gas-blast switch according to FIG. 1 with flow-off pipes having different dimensions.

In a gas-blast switch designed according to the invention, with a distance L lying within the above-mentioned range and measuring, for example, up to 0.30 m, the quenching-gas pressure curve $P_2$ shown in FIG. 2 is obtained immediately downstream of the nozzle orifice 10. It is evident from this that on a gas-blast switch of such dimensions, at the moment of zero crossing, that is to say at $t_0+T/2$, a quenching gas with a pressure $P_{2H}$ is available in the heating volume 6, and its pressure difference $\Delta P_2$ from the pressure $P_2$ of the quenching gas immediately downstream of the nozzle orifice 10 is approximately twice as high as the corresponding pressure difference $\Delta P_1$ in a gas-blast switch with a flow-off piper 11 of a size outside the above-mentioned range. The main reason for this is that, as the result of an appropriate calculation of the distance L, the pressure of the quenching gas at the moment of the zero crossing immediately behind the nozzle orifice 10 has dropped considerably below the value of the filling pressure $P_F$ of the quenching gas.

For gas-blast switches designed for comparatively low short-circuit currents, it is generally sufficient to make the distance L greater than c/20f and less than c/12f, since, because of the comparatively slight build-up of pressure in the heating volume 6, the flow-off pipe 11 then exerts a sufficient blocking effect until the appearance of a dilution wave reflected twice at the open end of the flow-off piper 11.

The cross-section of the flow-off pipe 11 should be made larger than the cross-section of the nozzle orifice 10, to ensure attainment of a desired pressure drop across nozzle orifice 10. It is recommended to make the cross-section of flow-off pipe 11 smaller than $0.8\times f\times V_H\times P_F/(\Delta P_{LB}\times c)$, $V_H$ being the size of the heating volume 6, f being the mains frequency of the current to be cut off, $P_F$ being the filling pressure of the quenching gas, $\Delta P_{LB}$ being that pressure built up at maximum current by the arc 8 in the heating volume 6 in addition to the filling pressure $P_F$, for which the blocking effect of the flow-off pipe 11 is still just required (generally approximately one bar), and c being the speed of sound.

With such dimensions, the energy loss caused when the heated quenching gas flows off into the space located in the flow-off pipe 11 downstream of the nozzle orifice 10 and upstream of the phase interface between hot and cold gas is limited to approximately 20%.

The flow-off pipe 11 can be cylindrical, as shown in FIG. 1. However, it can also be curved, as shown by broken lines in FIG. 1. This achieves the additional advantage that the exhaust gases enter the exhaust space 12 at any point (in particular, a point not subjected to dielectric stress).

It is also possible, as indicated in FIG. 1, to use several flow-off pipes instead of a single flow-off pipe 11. It is merely necessary to ensure, in this case, that the sum of the cross-sections of these flow-off pipes 11 is within the above-mentioned limits for the value of the cross-section of flow-off pipe 11.

Figure 3:
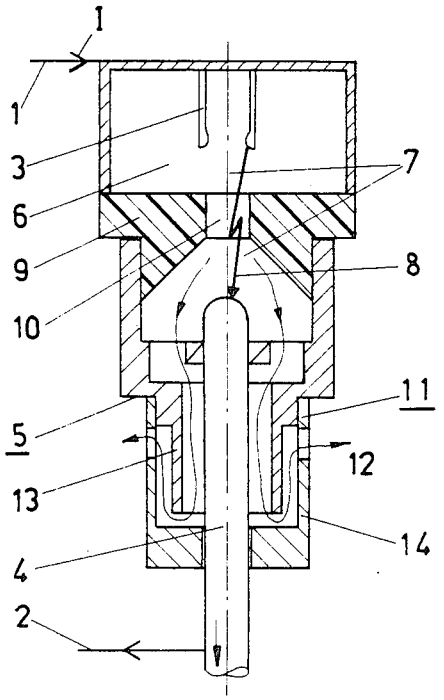
FIG. 3 is a plan view of a section through a second embodiment of a gas-blast switch of the invention.
Figure 4:
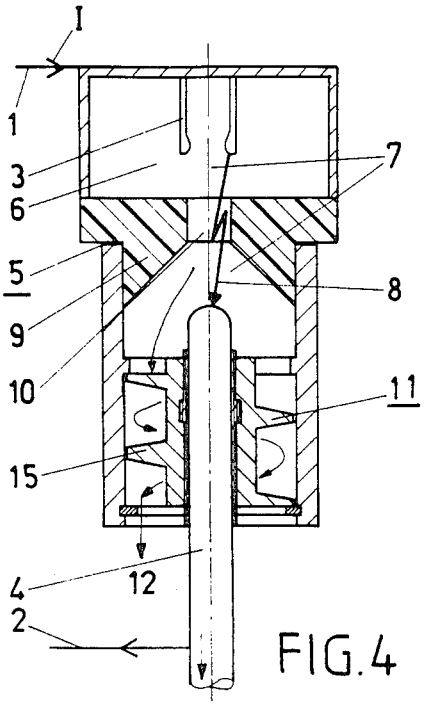
FIG. 4 is a plan view of a section through a third embodiment of a gas-blast switch of the invention.

To obtain a compact gas-blast switch according to the invention, it is possible, as indicated in FIG. 3, for the flow-off pipe to consist of two pipe sections 13 and 14 arranged concentrically relative to one another and guided centrally relative to the moveable contact piece 4 or, as indicated in FIG. 4, to design the flow-off piper 11 as a spiral 15 and arrange this spiral 15 peripherally relative to the moveable contact piece 4.

Figure 5:
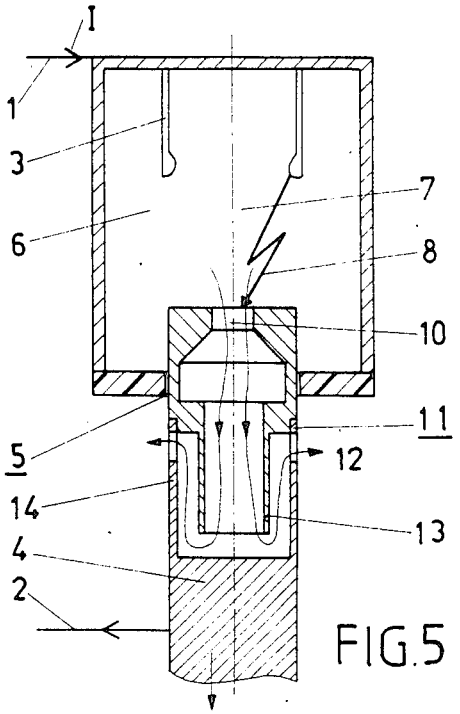
FIG. 5 is a plan view of a section through a fourth embodiment of a gas-blast switch of the invention.

As indicated in FIG. 5, it is also possible to arrange the flow-off pipe directly within moveable contact piece 4. It is also advantageous for the embodiment of FIG. 3, to construct flow-off pipe 11 from two concentric pipe sections 13 and 14.

The flow-off pipe should be constructed of a heat-resistant materials. To further cool the exhaust gases, it is advantageous to provide sufficient material of good thermal conductivity in the flow-off pipe. Such material is preferably made of metal such as, for example, copper or steel, and, for example, can form the entire wall of the flow-off pipe or be arranged only in a few places on this wall. In flow-off pipe constructed mainly of a metal having good thermal conductivity, it is recommended to make the average wall thickness of the pipe greater than 0.5 mm. The flow-off pipe then has sufficient thermal conductivity and thermal capacity to allow it to absorb for a short time a considerable proportion of the energy flowing, together with the exhaust gases, through nozzle orifice 10 into flow-off pipe 11 in the heating phase of the arc, when high short-circuit currents are switched. Heating of the exhaust space 12 is temporarily prevented in this manner, with the result that the pressure difference between the heating volume 6 and the exhaust space 12 is increased and the danger of exhaust flash-overs is reduced.

We claim:

1. A gas-blast switch, comprising:

a switch housing suitable to be filled with an arc quenching gas;

a switching chamber defined in the housing, the switching chamber including a heating volume wherein the quenching gas is heated during formation of an arc in the switch;

means for supplying the quenching gas to the switching chamber at a predetermined filling pressure;

first and second electrical contact pieces located in the switching chamber, the second contact piece being movable relative to the first contact piece, the disengagement of the first and second contact pieces being effective to create an arc in the heating volume for heating the quenching gas;

an exhaust space defined in the housing and located in spaced relation to the switching chamber, the exhaust space being effective for receiving the heated quenching gas from the switching chamber;

a nozzle orifice disposed in the flow path of the quenching gas between the heating volume and the exhaust space; and at least one flow-off pipe having a first end which opens to the switching chamber and a second end which opens to the exhaust space, the distance between the nozzle orifice and the second end of the flow-off pipe being greater than c/32f and less than c/5f, wherein c is the speed of sound associated with the quenching gas in the switching chamber and f is the frequency of a current to be interrupted by said gas-blast switch, the at least one flow-off pipe having a transversal cross-sectional size which is larger than a corresponding cross-sectional size associated with the nozzle orifice, and the transversal cross-sectional size of the flow-off pipe being smaller than $0.8\times f\times V_H\times P_F/(\Delta P_{LB}\times c)$, wherein $V_H$ represents the heating volume, $P_F$ represents said predetermined filling pressure of the quenching gas in the switching chamber, and $\Delta P_{LB}$ is that pressure which develops at maximum current of the arc in the heating volume above the filling pressure $P_F$, for which the blocking effect of the flow-off pipe is still just required.

2. A gas-blast switch according to claim 1, wherein said distance is greater than c/16f.

3. A gas-blast switch according to claim 2, wherein said distance is greater than c/10f.

4. A gas-blast switch according to claim 1, wherein the distance is less than c/10f.

5. A gas-blast switch according to claim 4, wherein the distance is greater than c/20f and less than c/12f.

6. A gas-blast switch according to claim 1, wherein said at least one flow-off pipe has a curved shape between its first and second ends.

7. A gas-blast switch according to claim 6, wherein the flow path of the arc quenching gas in the flow-off pipe between the first and second end is spirally shaped.

8. The gas-blast switch according to claim 1, wherein said at least one flow-off pipe includes outer and inner concentrically disposed pipe sections, wherein the outer pipe section includes an opening toward said exhaust space and the inner pipe section communicates with the switching chamber.

9. The gas-blast switch according to claim 1, wherein the at least one flow-off pipe is constructed of a material having good thermal conductivity.

10. The gas-blast switch according to claim 9, wherein the material comprises a metal and the flow-off pipe includes a peripherally extending wall having an average wall thickness which is greater than 0.5 mm.

11. A gas-blast switch, comprising:

a switch housing which is suitable for being filled with an arc quenching gas;

a switching chamber defined in the housing and a heating chamber located and in said switching chamber;

first and second electrical contact pieces disposed in the switching chamber, the second contact piece being movable with respect to the first contact piece, the disengagement of the contact pieces creating an arc which heats the quenching gas in the heating chamber;

an exhaust space defined in the housing and located in spaced relation to the switching chamber, the exhaust space being effective for receiving heated and pressurized quenching gas from the switching chamber;

a nozzle orifice defined in the housing and located for providing an escape path for the pressurized quenching gas within the heating chamber when the nozzle is opened;

a flow-off pipe extending between the switching chamber and the exhaust space, the second contact being movable through the nozzle orifice such that when the second contact piece clears the nozzle orifice the pressurized quenching gas in the heating volume rushes out of the switching chamber and through the flow-off pipe into the exhaust space;

means for supplying the quenching gas into the switching chamber at a predetermined filling pressure; and wherein the flow-off pipe includes a first opening in the switching chamber and a second opening in the exhaust space and further includes a predetermined transversal cross-sectional area, and the distance from the nozzle orifice to the second opening of the pipe is effective to produce a pressure drop in a region located adjacent the nozzle orifice and downstream thereof in the flow direction of the quenching gas such that at approximately the instant where an arc current, which is present between the contact pieces, reaches a zero crossing, the pressure at the downstream end of the nozzle orifice is substantially below the predetermined filling pressure at which the gas quenching is supplied.

12. The gas-blast switch of claim 11, in which the distance is greater than c/32f and less than c/5f wherein c is the speed of sound associated with the quenching gas in the switching chamber and f is the frequency of the arc current which is to be interrupted.

13. The gas-blast switch according to claim 11, in which the transversal cross-section of the flow-off pipe is larger than a corresponding cross-sectional area of the nozzle orifice and wherein the transversal cross-sectional size of the flow pipe is smaller than $0.8\times f\times V_H\times P_F/(\Delta P_{LB}\times c)$, wherein $V_H$ represents the heating volume, $P_F$ represents said predetermined filling pressure of the quenching gas in the switching chamber, and $\Delta P_{LB}$ is that pressure which develops at maximum current of the arc in the heating volume above the filling pressure $P_F$, for which the blocking effect of the flow-off pipe is still just required.

14. The gas-blast switch according to claim 13, wherein the flow-off pipe is curved between its first and second openings.

15. A gas-blast switch according to claim 14, wherein the flow path of the quenching gas flow through the flow-off pipe is spirally shaped.

* * * * *